US006098715A

United States Patent [19]

Seixas et al.

[11] Patent Number: 6,098,715

[45] Date of Patent: Aug. 8, 2000

[54] FLOWLINE CONNECTION SYSTEM

[75] Inventors: Ricardo Moreira Seixas; Bruno Schauerte, both of Rio de Janeiro, Brazil

[73] Assignee: ABB Vetco Gray Inc., Houston, Tex.

[21] Appl. No.: 09/124,715

[22] Filed: Jul. 30, 1998

Related U.S. Application Data

[60] Provisional application No. 60/054,254, Jul. 30, 1997.

[51] Int. Cl.[7] ..... E21B 33/038

[52] U.S. Cl. ..... 166/347; 166/344; 166/341

[58] Field of Search ..... 166/342, 341, 166/349, 347, 343; 285/24, 27; 405/169

[56] References Cited

U.S. PATENT DOCUMENTS

| | | | |
|---|---|---|---|
| Re. 27,340 | 4/1972 | Williams et al. | 166/347 |
| 3,486,556 | 12/1969 | Burgess | 122/269 |
| 3,874,706 | 4/1975 | Arnold | 285/24 |
| 3,924,446 | 12/1975 | Baugh | 73/37 |
| 4,120,171 | 10/1978 | Chateau et al. | 405/169 |
| 4,223,920 | 9/1980 | Van Bilderbeek | 285/24 |
| 4,286,665 | 9/1981 | Walker | 166/339 |
| 4,298,218 | 11/1981 | Britch | 285/3 |
| 4,399,872 | 8/1983 | McConaughy et al. | 166/341 |
| 4,641,998 | 2/1987 | Baugh | 405/169 |
| 4,823,878 | 4/1989 | Brammer et al. | 166/341 |
| 4,867,605 | 9/1989 | Myers et al. | 405/169 |
| 4,899,822 | 2/1990 | Daeschler et al. | 166/339 |
| 5,005,650 | 4/1991 | Hopper | 166/339 |
| 5,088,558 | 2/1992 | Mohn | 166/339 |

*Primary Examiner*—Eileen Dunn Lillis
*Assistant Examiner*—Frederick L. Lagman
*Attorney, Agent, or Firm*—Felsman, Bradley, Vaden, Gunter & Dillon, L.L.P.; James E. Bradley

[57] ABSTRACT

A flowline connection apparatus having a pivotally mounted funnel an upright frame, which is a permanent part of a subsea well installation such as a manifold or subsea production tree. The funnel rotates is rotatably mounted to rotate from a vertical position to a horizontal position. Retractable pins engage a slot in the funnel to lock the funnel in a vertical position or can be retracted to unlock the funnel, allowing the funnel to rotate to the horizontal position to engage a hub connector. A flowline end termination stabs into the funnel while the funnel is in the vertical position. The flowline termination body has a flange connector on one end that connects to a flexible flowline. The body has an annular external recess for securing the body within the funnel once in place. Pins engage the annular recess to hold the flowline end termination body in the engaged position. A mandrel is carried within an axial bore of the body for axial reciprocal movement. The body has a nose on its lower end which is tapered to facilitate entry into the funnel. The mandrel has a flowline connector hub on its downstream end that is recessed within the nose of the body while in the retracted position and protrudes out while in the extended position. The mandrel is stroked from a retracted position to an extended position. In the extended position, the hub on the mandrel will engage a mating hub. A hub connecter has movable segments that clamp the hub and mating hub together to form a sealed connection.

10 Claims, 4 Drawing Sheets

FLOWLINE CONNECTION SYSTEM

CROSS-REFERENCE TO RELATED APPLICATIONS

This application claims the benefit of provisional application number 60/054,254, filed Jul. 30, 1997.

TECHNICAL FIELD

This invention relates in general to subsea well installations and in particular to a flowline apparatus for connecting a flowline to a subsea well installation.

BACKGROUND OF THE INVENTION

In offshore oil and gas production, pipelines or flowlines are often lowered from vessels and laid on the sea floor. A flowline pull-in apparatus is used to pull the line into the well remotely to make a connection.

U.S. Pat. No. 3,866,677, issued to Baugh, discloses an underwater pipe connection apparatus for making fluid connection to a well drilled into a formation underlying a body of water. A storage flowline is positioned for alignment with a Christmas tree flowline by a combination of wireline apparatus and hydraulic apparatus controlled on the surface. Baugh teaches a flowline pulling tool which has a gunnel assembly that may be pivoted downwardly with the storage flowline attached thereto to a position where the storage flowline is in axial alignment with the Christmas tree flowline.

Similarly, U.S. Pat. No. 3,973,625, issued to Baugh, and U.S. Pat. No. 4,277,202, issued to Archambaud et al. teach a pivoting or articulating connector.

SUMMARY OF THE INVENTION

The invention is a flowline connection apparatus having a funnel mounted to an upright frame by two co-axial pins. The frame is a permanent part of a subsea well installation such as a manifold or subsea production tree. The funnel rotates about the pins from a vertical position to a horizontal position.

The pins have an engagement member that engages a slot in the funnel to lock the funnel in a vertical position. The pins can be retracted to unlock the funnel, allowing the funnel to rotate to the horizontal position.

A hub connector is mounted next to the funnel on the frame. The hub connector is mounted on an upright support. The hub connector supports a sub, which has a connector flange attached thereto, which in turn will be coupled to a flowline from a manifold or a production tree.

A flowline end termination is lowered into the funnel while the funnel is in the vertical position. The flowline termination has a flange connector on one end that connects to a flexible flowline. The flowline termination also has a body that is tubular and of a diameter for close sealing reception within a cylindrical portion of the funnel. The body has an annular external recess for securing the body within the funnel once in place. The pins will engage the annular recess to hold the flowline end termination in the engaged position. Because the recess is annular, no rotational orientation of the body is required.

A mandrel is carried within an axial bore of the body for axial reciprocal movement. The mandrel is tubular and has an annular external piston which surrounds it for stroking the mandrel from a retracted position to an engaged position. Hydraulic passages extend from a chamber, which contains a piston, to the exterior of the body. The body has a nose on its lower end which is tapered to facilitate entry into the funnel. The mandrel has a flowline connector hub on its downstream end that is recessed within the nose of the body while in the retracted position and protrudes out while in the extended position.

Hydraulic fluid pressure is provided to the hydraulic passageways to stroke the mandrel from the retracted position to the extended position. In the extended position, the hub on the mandrel will engage a mating hub. A hub connecter having movable segments clamps the hub and mating hub together to form a sealed connection.

In operation, the funnel and associated equipment, including the flange connector, are previously installed at the sea floor on a guide frame of a production manifold or tree. The funnel will be held in a vertical position by the pins. An operator connects a flexible flowline to the flange connector at the surface and lowers the flowline termination on cables. The flowline termination will stab into the funnel. The pins are then extended inward to lock the flowline termination to the funnel and to unlock the funnel to allow rotation of the funnel into a horizontal position.

Hydraulic fluid pressure is then applied to cause the mandrel to extend. The hub connector is then engaged to cause the segments of the hub connector to pull the hubs together in sealing engagement.

BEST MODE FOR CARRYING OUT THE INVENTION

Figure 1:
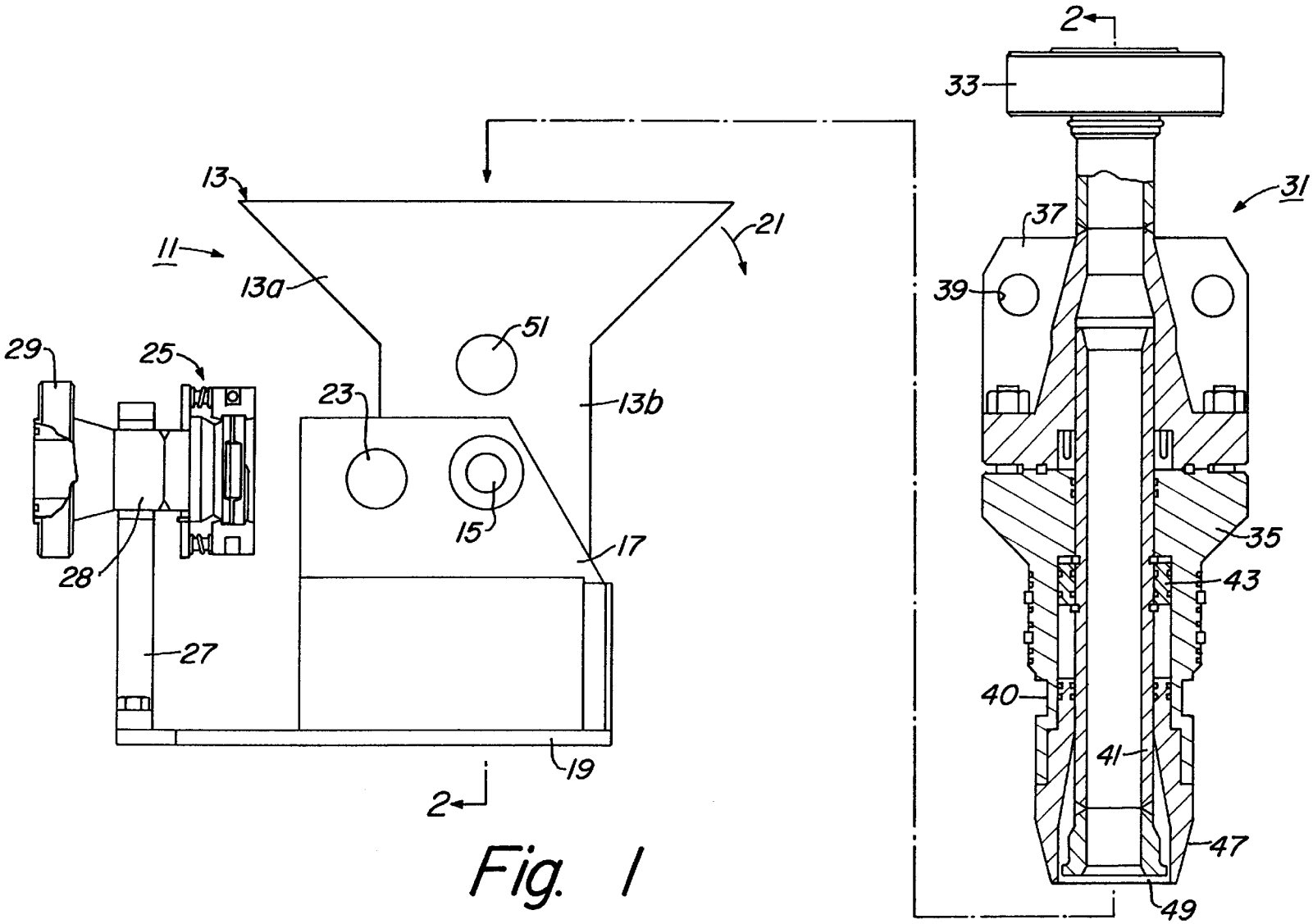
FIG. 1 is a side view, partially sectioned, of a subsea flowline connection apparatus constructed in accordance with this invention, with a flowline end termination shown prior to landing in a funnel.

Referring to FIG. 1, flowline connection apparatus 11 has a funnel 13 which has an upper conical portion 13*a* and a lower cylindrical portion 13*b*. Funnel 13 is mounted by two co-axial pins 15 to upright frame walls 17. Frame walls 17 are mounted to a guide frame 19 that is a permanent part of a subsea well installation such as a manifold or subsea production tree. As indicated by arrow 21, funnel 13 will rotate about pins 15 from a vertical position, shown in FIGS. 1–2, to a horizontal position, shown in FIGS. 3–5.

Pins 15 also have an engagement member (not shown) which engages a slot (not shown) in funnel portion 13*b* to lock funnel 13 in the vertical position. Pins 15 can be retracted to unlock funnel 13, allowing funnel 13 to rotate to the horizontal position. Pin 23 is preferably extended and retracted by hydraulic fluid pressure which will be supplied through port 23 by a remote operated vehicle (ROV). In one embodiment, the engagement member comprises a polygonal section on pins 15 which engages a polygonal recess in the holes in frame walls 17. A key on each pin 15 locks funnel 13 to the pins 15 rotationally. When retracted, the polygonal member retains funnel 13 against rotation. When extended further inward, the polygonal member would release from the recess, allowing pin 15 and funnel 13 to rotate relative to frame walls 17.

A hub connector 25 is mounted next to funnel 13 on guide frame 19. Hub connector 25 is mounted on an upright support 27. Hub connector 25 is preferably of a clamp-type such as shown in U.S. Pat. No. 5,468,023, issued Nov. 21, 1995. Hub connector 25 supports a sub 28, which has on one end a connector flange 29, which in turn will be coupled to a flowline (not shown) from a manifold or a production tree.

A flowline end termination 31 stabs into funnel 13 while it is in the vertical position. Flowline termination 31 has a flange connector 33 on one end which connects to a flexible flowline (not shown). Flowline termination 31 also has a body 35 that is tubular and of a diameter for a close sealing reception within funnel cylindrical portion 13*b*. Gussets 37 with holes 39 are mounted to flowline termination 31 to enable flowline termination 31 to be lowered by cable in a vertical orientation. Body 35 has an annular external recess 40 for securing body 35 within funnel 13 once in place. Pins 15 will engage recess 40 to hold termination 31 in the engaged position.

A mandrel 41 is carried within an axial bore of body 35 for axial reciprocal movement. Mandrel 41 is tubular and has an annular external piston 43 which surrounds it for stroking mandrel 41 from a retracted position, shown in FIG. 1, to an engaged position, which is shown on the upper half of mandrel 41 in FIG. 4. Hydraulic passages 45 extend from a chamber which contains piston 43 to the exterior of body 35. Body 35 has a nose 47 on the lower end which is tapered to facilitate entry into funnel cylindrical portion 13*b*. Mandrel 41 has a flowline connector hub 49 on its downstream end which is recessed within nose 47 while in the retracted position and protrudes out while in the extended position.

Figure 2:
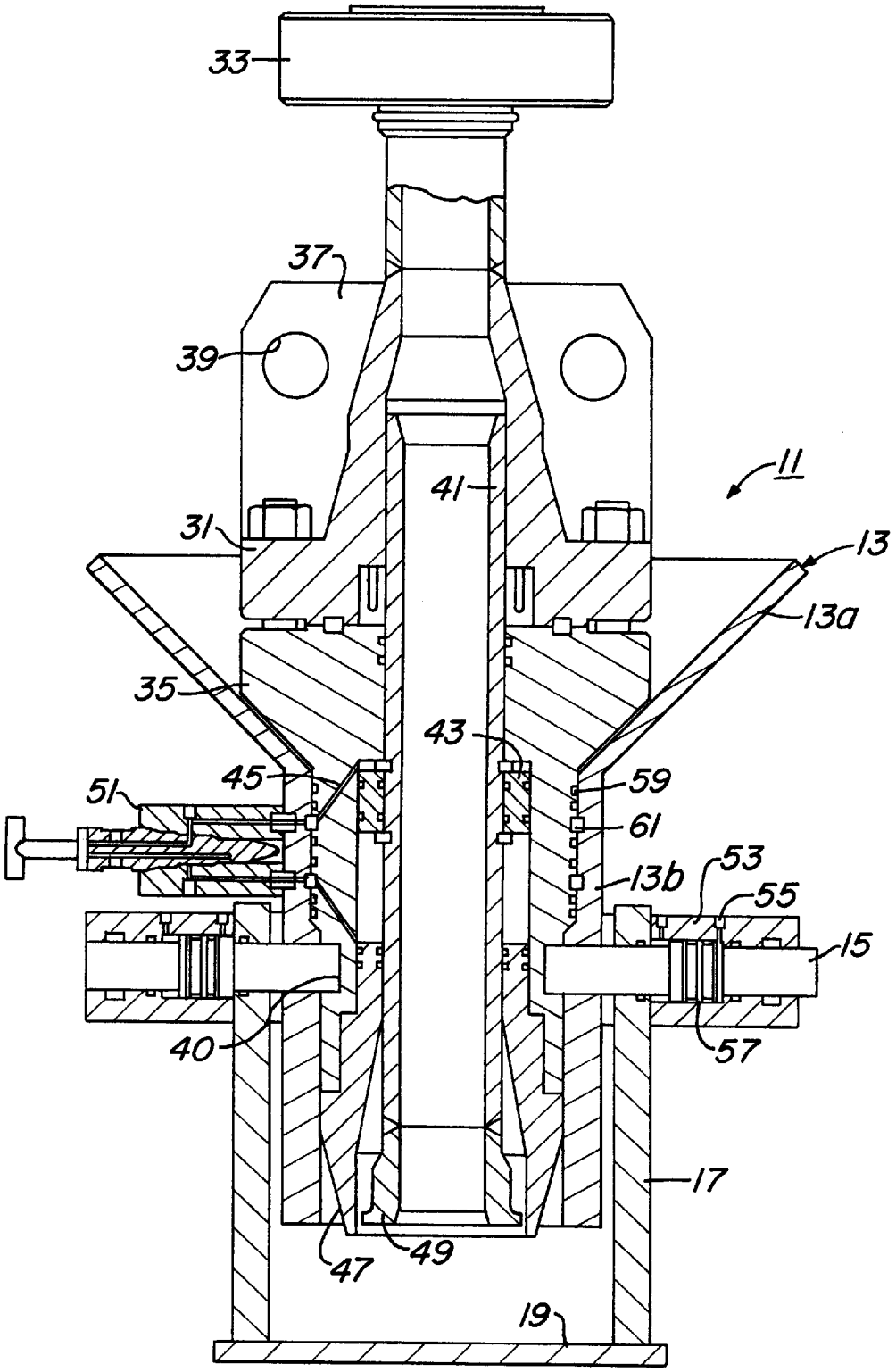
FIG. 2 is a vertical sectional view of the flowline connection apparatus of FIG. 1, showing the flowline end termination stabbed into engagement with the funnel, the sectional view being taken in a plane 90° from the view shown in FIG. 1, and showing the funnel still in a vertical position.
Figure 3:
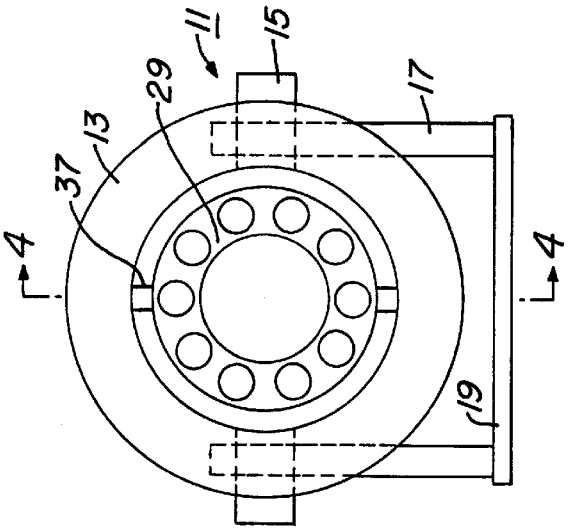
FIG. 3 is an end view of the flowline connection apparatus of FIG. 1, shown with the flowline end termination in engagement with the funnel and the funnel rotated to a horizontal position.

A hydraulic stab 51 mounts to funnel cylindrical portion 13*b* for accessing hydraulic passages 45 after flowline termination 31 is stabbed into funnel 13. An ROV will engage hydraulic stab 51 to supply hydraulic fluid pressure to stroke mandrel 41 from the retracted position to the extended position. FIG. 2 shows flowline termination 31 in locking engagement with funnel 13, but before funnel 13 has been rotated to the horizontal position and before mandrel 41 is moved to the extended position.

As shown in FIG. 2, pins 15 are axially slidable on a common axis. Each pin 15 is mounted in a housing 53 which has hydraulic passages 55. Hydraulic passages 55 are engaged by an ROV through port 23 to supply hydraulic power to stroke pins 15 inward to engage annular recess 40 on flowline termination 31. Because recess 40 is annular, no rotational orientation is required. FIG. 2 shows both retracted and engaged positions, with pin 15 on the right side in the retracted piston, wherein it provides support to funnel 13 but does not protrude inward into funnel portion 13*b*. Pin 15 on the left side of FIG. 2 is shown in locking engagement with recess 40. Each pin 15 has a piston 57 which is annular and located within a chamber in housing 53 for being stroked by hydraulic fluid supplied through passages 55.

Referring still to FIG. 2, flowline termination body 35 has a pair of annular seals 59 located above and below each of two annular grooves 61. Grooves 61 communicate with the two hydraulic passages 45 for stroking mandrel 41. Grooves 61 will align with hydraulic stab 51 once flowline termination 31 is in the fully engaged position. Annular seals 59 and grooves 61 allow hydraulic makeup to occur when flowline termination 31 is in the horizontal position without any rotational orientation required of body 35 relative to funnel 13.

Figure 4:
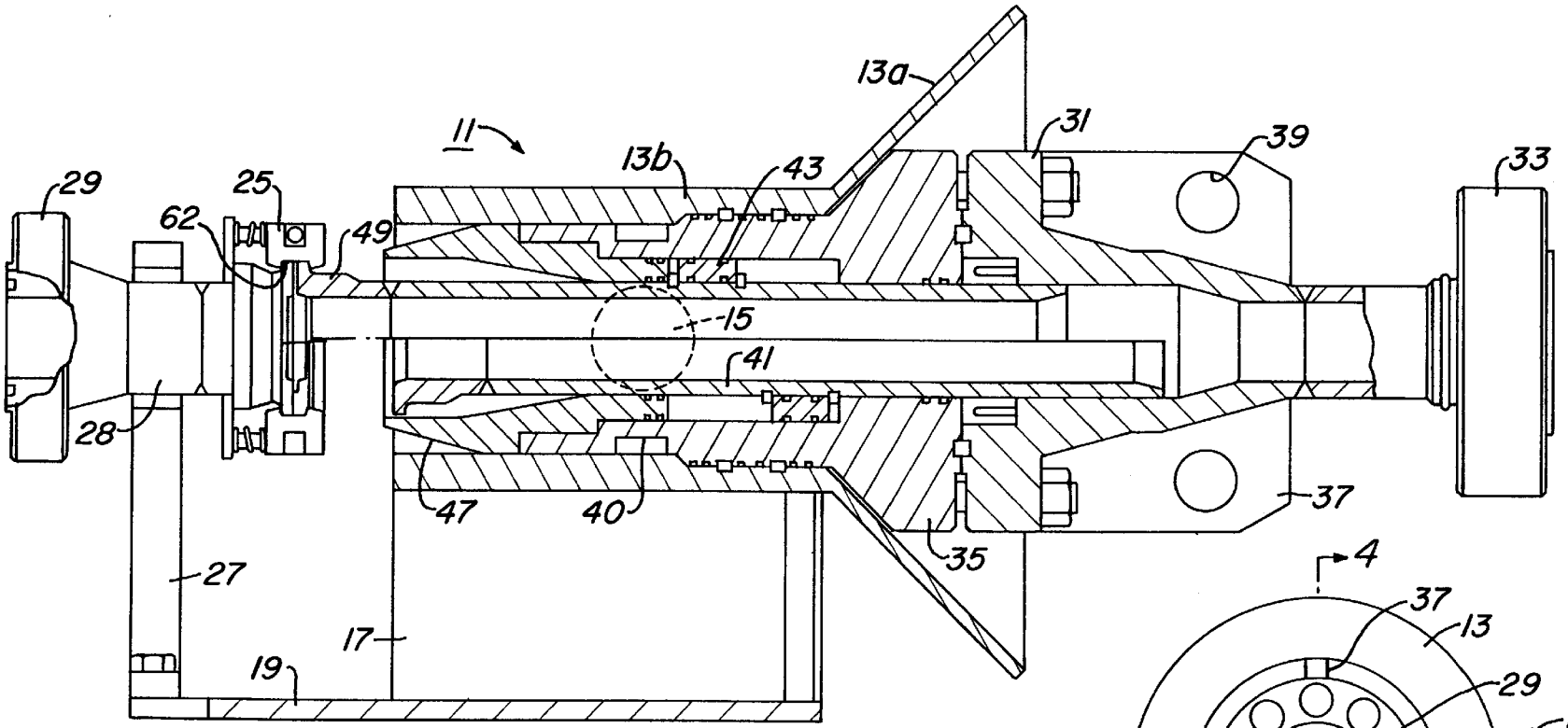
FIG. 4 is a sectional view of the flowline connection apparatus of FIG. 1, taken along the line 4—4 of FIG. 3.
Figure 5:
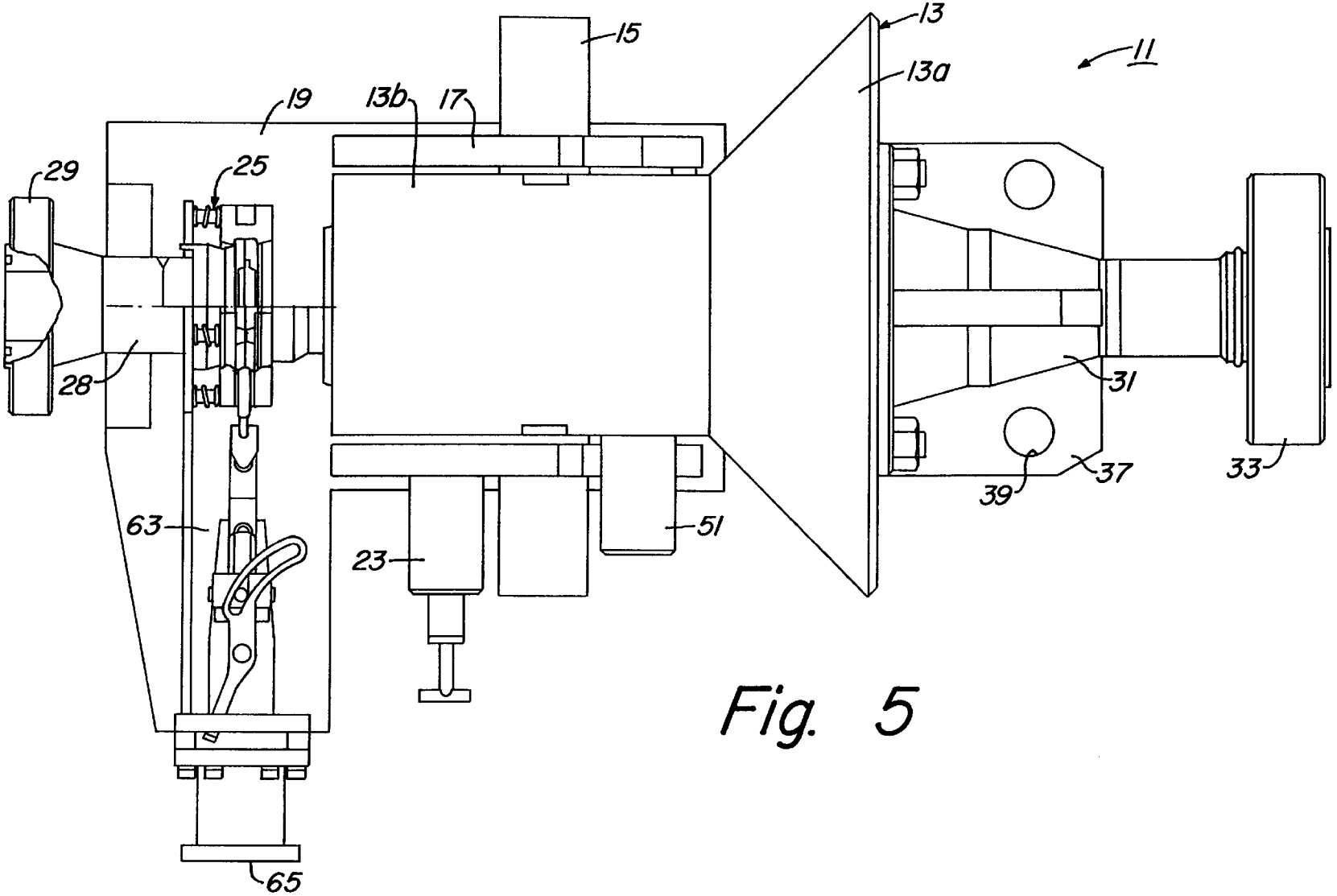
FIG. 5 is a top view of the flowline connection apparatus of FIG. 1, with the flowline end termination installed in the funnel and with the funnel rotated to the horizontal position.

FIG. 4 shows flowline termination 31 locked into funnel 13 and funnel 13 rotated to the horizontal position. A stop (not shown) supports funnel 13 in the horizontal position. FIG. 4 also shows mandrel 41 in both the retracted and extended positions. The upper half of mandrel 41 is shown extended while the lower half is shown retracted. In the extended position, hub 49 will engage a mating hub 62 which is on an opposite end of sub 28 from flange connector 29 and is located within hub connecter 25. Hub connecter 25 has movable segments which clamp the hubs 49, 62 together to form a sealed connection. As shown in FIG. 5, preferably the actuator for moving the clamp segments of hub connector 25 is a mechanical type having a rotary drive shaft assembly 63 which has a socket 65 for access by the ROV. The ROV will rotate a drive shaft within assembly 63 to cause hub connector 25 to tightly clamp the hubs 49, 62 together.

In operation, funnel 13 and associated equipment will be previously installed at the sea floor on a guide frame 19 of a production manifold or tree. Flange connector 29 will be previously coupled to the subsea well installation. Funnel 13 will be held in a vertical position by pins 15. The operator connects a flexible flowline to flange connector 33 at the surface then lowers flowline termination 31 on cables connected to gussets 37. Flowline termination 31 will stab into funnel 13. An ROV is deployed then to extend pins 15 inward via ROV hot stab port 23 to lock flowline termination 31 to funnel 13 and unlock funnel 13 to allow rotation into the horizontal position.

The ROV then accesses hydraulic stab 51 and applies hydraulic fluid pressure to cause mandrel 41 to extend as shown in FIG. 4. The ROV then engages socket 65 of drive shaft assembly 63 (FIG. 5) and rotates the drive shaft to cause the segments of hub connector 25 to pull hubs 49, 62 together in sealing engagement.

The invention has significant advantages. By providing a funnel that may be oriented in a vertical position, the flowline end termination may be lowered into the funnel from the surface.

While the invention has been shown in only one of its forms, it should be apparent to those skilled in the art that it is not so limited, but is susceptible to various changes without departing from the scope of the invention.

What is claimed is:

1. Apparatus for connecting a flowline to a subsea well installation comprising:

a guide frame adapted to be affixed to a subsea well installation;

a funnel having an upper conical portion and a lower cylindrical portion, said lower cylindrical portion having a wall with an aperture therein, said funnel being pivotally mounted to said guide frame and rotatable from a vertical position to a laterally oriented position;

a retractable pin mounted to said guide frame for selectively engaging said aperture in said funnel while in a retracted position to lock said funnel in said vertical position and when said pin is in an extended position, to allow said funnel to rotate to said laterally oriented position;

a tubular flowline termination body adapted to be connected to a flowline and lowered into said funnel while in said vertical position, said body having an axial bore and an outer diameter for close sealing reception within said lower cylindrical portion of said funnel, said flowline termination body having a nose and a recess on said body for receiving said retractable pin while in said extended position therein to selectively secure said flowline termination body within said funnel;

a retractable tubular mandrel having a flowline connector hub on a terminal end thereof, said connector hub being recessed within said nose while in a retracted position and protruding out of said nose while in an extended position, said mandrel being carried within said axial bore of said flowline termination body;

a piston affixed to said tubular mandrel within said axial bore of said flowline termination body; and a hydraulic passage extending from an exterior of said funnel and in communication with said piston for supplying hydraulic fluid for stroking said mandrel from said retracted position to said extended position.

2. The apparatus according to claim 1 wherein said retractable pin is extended and retracted by hydraulic fluid pressure which is adapted to be supplied through a port by a remote operated vehicle.

3. The apparatus according to claim 1 further comprising:

a mating hub affixed to said guide frame and positioned to be engaged by said flowline connector hub on said mandrel; and a hub connector mounted to said guide frame and having movable segments for clamping said mating hub and said flowline connector hub together.

4. The apparatus according to claim 1 wherein:

said recess is annular so that said tubular flowline termination body need not be oriented rotationally to receive said retractable pin.

5. Apparatus for connecting a flowline to a subsea well installation comprising:

a guide frame adapted to be affixed to a subsea well installation;

a funnel having an upper conical portion and a lower cylindrical portion, said lower cylindrical portion having a wall with an aperture therein, said funnel being mounted to said guide frame for movement between a vertical position and a laterally oriented position;

a retractable pin mounted to said guide frame for selectively engaging said aperture in said funnel while in a retracted position to lock said funnel in said vertical position and when said pin is in an extended position, to allow said funnel to rotate to said laterally oriented position;

a tubular flowline termination body adapted to be connected to a flowline and lowered into said funnel while said funnel is in said vertical position, said body having an axial bore and an outer diameter for close sealing reception within said lower cylindrical portion of said funnel, said flowline termination body having a nose and a recess on said body for receiving said retractable pin while in said extended position therein to selectively secure said flowline termination body within said funnel and for allowing said funnel to be rotated to said laterally oriented position;

a retractable tubular mandrel having a flowline connector hub on a terminal end thereof, said connector hub being recessed within said nose while in a retracted position and protruding out of said nose while in an extended position, said mandrel being carried within said axial bore of said flowline termination body;

a piston affixed to said tubular mandrel within said axial bore of said flowline termination body; and a hydraulic passage extending from an exterior of said funnel and in communication with said piston for supplying hydraulic fluid for stroking said mandrel from said retracted position to said extended position.

6. A connector for connecting a flowline to a subsea well installation comprising:

a guide frame adapted to be affixed to a subsea well installation;

a funnel pivotally mounted to said guide frame, said funnel being pivotal from a laterally oriented position to a vertical position;

a first hub connector mounted to said guide frame and adapted to be connected to a flowline of the subsea well installation;

a tubular flowline termination body adapted to be secured to a flowline and lowered into said funnel when said funnel is in the vertical position, said tubular flowline termination body having an axial bore and an outer surface for close reception within said funnel, said body having a second hub connector on an end; and said funnel being pivotal relative to the guide frame from the vertical position to the laterally oriented position to align the hub connector of the termination body with the hub connector of the guide frame to connect said first and second hub connectors together.

7. The connector according to claim 6 further comprising:

a retractable pin affixed to said guide frame for selectively engaging an aperture in said funnel.

8. The connector according to claim 6 further comprising:

a tubular mandrel within the axial bore of said termination body and being movable relative to the termination body between retracted and extended positions, said second hub connector being on a terminal end of the mandrel, said second hub connector being recessed within said termination body while in the retracted position and protruding out of said termination body while in the extended position; and a piston affixed to said tubular mandrel within said axial bore of said flowline termination body for moving the mandrel between said positions.

9. The connector according to claim 6 further comprising:

a retractable pin affixed to said guide for selectively engaging an aperture in said funnel to retain said funnel in the vertical position.

10. A method of connecting a flowline to a subsea well installation comprising the steps of:

affixing a guide frame to a subsea well installation;

pivotally mounting a funnel to said guide frame, said funnel being pivotal from a laterally oriented position to a vertical position;

mounting a first hub connector to said guide frame;

securing a tubular flowline termination body to a flowline, said body having a second hub connector on an end;

lowering said body into said funnel when said funnel is in the vertical position; and pivoting said funnel relative to the guide frame from the vertical position to the laterally oriented position to align the second hub connector with the first hub connector to connect the hub connectors together.

* * * * *

UNITED STATES PATENT AND TRADEMARK OFFICE

CERTIFICATE OF CORRECTION

PATENT NO. : 6,098,715

DATED : August 8, 2000

INVENTOR(S) : Ricardo Moreira Seixas and Bruno Schauerte

It is certified that error appears in the above-indentified patent and that said Letters Patent is hereby corrected as shown below:

In the Abstract, Line 4, delete "funnel" and insert --funnel,--.

In the Abstract, Line 6, delete "rotates" and delete "rotatably".

Column 1, Line 27, delete "gunnel" and insert -funnel;--.

Signed and Sealed this

Tenth Day of April, 2001

*Attest:*

Nicholas P. Godici

NICHOLAS P. GODICI

*Attesting Officer*

*Acting Director of the United States Patent and Trademark Office*